US009745693B2

(12) United States Patent
Schindzielorz et al.

(10) Patent No.: US 9,745,693 B2
(45) Date of Patent: Aug. 29, 2017

(54) FLAME RESISTANT FABRIC FOR AVIATION AIRBAGS

(71) Applicants: Michael H. Schindzielorz, Kernersville, NC (US); Akira Kokeguchi, Tokyo (JP)

(72) Inventors: Michael H. Schindzielorz, Kernersville, NC (US); Akira Kokeguchi, Tokyo (JP)

(73) Assignee: SCHROTH SAFETY PRODUCTS, LLC, Pompano Beach, FL (US)

( * ) Notice: Subject to any disclaimer, the term of this patent is extended or adjusted under 35 U.S.C. 154(b) by 0 days.

(21) Appl. No.: 14/516,869

(22) Filed: Oct. 17, 2014

(65) Prior Publication Data

US 2015/0267325 A1 Sep. 24, 2015

Related U.S. Application Data

(60) Provisional application No. 61/954,847, filed on Mar. 18, 2014.

(51) Int. Cl.

| | |
|---|---|
| ***D06M 11/00*** | (2006.01) |
| ***D03D 1/02*** | (2006.01) |
| ***D06M 15/564*** | (2006.01) |
| ***D06M 11/70*** | (2006.01) |
| ***D03D 15/12*** | (2006.01) |

(52) U.S. Cl.

CPC ..... *D06M 11/00* (2013.01); *D03D 1/02* (2013.01); *D03D 15/12* (2013.01); *D06M 11/70* (2013.01); *D06M 15/564* (2013.01); *D10B 2331/04* (2013.01); *D10B 2505/124* (2013.01); *Y10T 442/2656* (2015.04); *Y10T 442/2672* (2015.04); *Y10T 442/2721* (2015.04)

(58) Field of Classification Search

CPC ..... B64D 11/06; B64D 25/02; B64D 25/06; D03D 1/02; D03D 1/04; D06M 1/00; D06M 11/70; D06M 15/564

See application file for complete search history.

(56) References Cited

U.S. PATENT DOCUMENTS

| | | | |
|---|---|---|---|
| 4,045,513 A | 8/1977 | Knopka | |
| 4,430,089 A | 2/1984 | Toy et al. | |
| 5,215,795 A | 6/1993 | Matsumoto et al. | |
| 5,486,210 A | 1/1996 | Kerr et al. | |
| 6,429,155 B1 * | 8/2002 | Li et al. | 442/76 |

(Continued)

*Primary Examiner* — Arti Singh-Pandey

(74) *Attorney, Agent, or Firm* — Trueba & Suarez, PLLC; Roberto M. Suarez, Esq.

(57) ABSTRACT

A flame resistant fabric for the use in the construction of aviation airbags comprises a polyester fiber substrate which is treated with a first flame retardant. A polyurethane coating is applied to the polyester fiber substrate, which has been treated with the first flame retardant, to impart high pressure permeability resistance to the flame resistant fabric. The polyurethane coating comprises a second flame retardant to insure that the flame resistant fabric complies with Federal Aviation Requirement 25.853. The flame resistant fabric further comprises sufficient high pressure permeability resistance which is measured as a pressure of not less than about 198 kPa after five seconds from an initial inflation and pressurization to about 200 kPa, such as may be encountered in and during an inflation of aviation airbag assemblies.

1 Claim, 5 Drawing Sheets

Flame Resistant Polyester Fabric Coated w/ Flame Resistant Polyurethane

Federal Aviation Requirement 25.853 Vertical Flammability

| Specimen | Flame Time, seconds [not to exceed 15] | Burn Length, inches [not to exceed 8] | Drip Flame ,seconds [not to exceed 5] | Conclusion |
|---|---|---|---|---|
| 1 | 10.0 | 4.6 | 0.0 | PASS |
| 2 | 6.0 | 4.6 | 0.0 | |
| 3 | 0.0 | 4.4 | 0.0 | |
| AVG. | 5.3 | 4.5 | 0.0 | |

(56) References Cited

U.S. PATENT DOCUMENTS

| | | | | |
|---|---|---|---|---|
| 6,458,725 | B1 | 10/2002 | Masuda et al. | |
| 6,569,928 | B1 | 5/2003 | Levchik et al. | |
| 6,586,059 | B1 | 7/2003 | Michiels | |
| 6,713,131 | B2 | 3/2004 | Blackwood et al. | |
| 6,734,123 | B2 | 5/2004 | Veiga et al. | |
| 6,905,985 | B1 | 6/2005 | Schindzielorz et al. | |
| 7,645,825 | B2 | 1/2010 | Seki | |
| 7,737,058 | B2 | 6/2010 | Keshavaraj et al. | |
| 7,737,059 | B1 | 6/2010 | Keshavaraj et al. | |
| 7,947,204 | B2 | 5/2011 | Chakraborty et al. | |
| 8,211,813 | B2 | 7/2012 | Morimoto et al. | |
| 8,377,833 | B2 | 2/2013 | Schulthess | |
| 2002/0182967 | A1 | 12/2002 | Erb, Jr. et al. | |
| 2003/0036326 | A1 | 2/2003 | Takagi et al. | |
| 2005/0238842 | A1 | 10/2005 | Schindzielorz et al. | |
| 2009/0292032 | A1* | 11/2009 | Gupta et al. | 521/85 |
| 2013/0052900 | A1* | 2/2013 | Jung et al. | 442/187 |
| 2013/0241183 | A1 | 9/2013 | Keshavaraj et al. | |
| 2014/0000751 | A1* | 1/2014 | Kagumba | C08G 63/916<br>139/420 R |
| 2014/0308505 | A1* | 10/2014 | Schmitt | D01F 6/90<br>428/221 |

* cited by examiner

Silicone Coated Nylon Fabric

Federal Aviation Requirement 25.853 Vertical Flammability

| Specimen | Flame Time, seconds [not to exceed 15] | Burn Length, inches [not to exceed 8] | Drip Flame ,seconds [not to exceed 5] | Conclusion |
|---|---|---|---|---|
| 1 | 3.4 | 4.6 | nothing | NG |
| 2 | 96.0 | 5.2 | 3.2 | |
| 3 | 62.0 | 5.6 | 5.1 | |
| AVG. | 53.8 | 5.1 | 2.8 | |

Fig. 1

Uncoated Flame Resistant Polyester Fabric

Federal Aviation Requirement 25.853 Vertical Flammability

| Specimen | Flame Time, seconds [not to exceed 15] | Burn Length, inches [not to exceed 8] | Drip Flame ,seconds [not to exceed 5] | Conclusion |
|---|---|---|---|---|
| 1 | 0.0 | 3.5 | 0.0 | PASS |
| 2 | 0.0 | 3.3 | 0.0 | |
| 3 | 0.0 | 5.0 | 0.0 | |
| AVG. | 0.0 | 3.9 | 0.0 | |

Fig. 2

Flame Resistant Polyester Fabric Coated w/ Flame Resistant Polyurethane

Federal Aviation Requirement 25.853 Vertical Flammability

| Specimen | Flame Time, seconds [not to exceed 15] | Burn Length, inches [not to exceed 8] | Drip Flame ,seconds [not to exceed 5] | Conclusion |
|---|---|---|---|---|
| 1 | 10.0 | 4.6 | 0.0 | PASS |
| 2 | 6.0 | 4.6 | 0.0 | |
| 3 | 0.0 | 4.4 | 0.0 | |
| AVG. | 5.3 | 4.5 | 0.0 | |

Fig. 3

High Pressure Permeability Data

| High Pressure Air Permeability (1-10 sec) (1 sec Interval) | | | | | | | | | |
|---|---|---|---|---|---|---|---|---|---|
| | | | | | | | | | |
| | | | | | | | | | |
| | 1 | 2 | 3 | AVG. | | 4 | 5 | 6 | AVG. |
| | (kPa) | (kPa) | (kPa) | (kPa) | | (kPa) | (kPa) | (kPa) | (kPa) |
| 1 | 200 | 200 | 200 | 200 | | 200 | 200 | 200 | 200 |
| 2 | 200 | 200 | 200 | 200 | | 200 | 200 | 200 | 200 |
| 3 | 200 | 200 | 200 | 200 | | 199 | 200 | 200 | 199.7 |
| 4 | 200 | 200 | 200 | 200 | | 200 | 200 | 200 | 200 |
| 5 | 199 | 200 | 200 | 199.7 | | 200 | 200 | 200 | 200 |
| 6 | 200 | 200 | 200 | 200 | | 200 | 200 | 200 | 200 |
| 7 | 200 | 200 | 200 | 200 | | 200 | 200 | 200 | 200 |
| 8 | 200 | 200 | 199 | 199.7 | | 200 | 200 | 200 | 200 |
| 9 | 200 | 200 | 200 | 200 | | 200 | 199 | 200 | 199.7 |
| 10 | 200 | 200 | 200 | 200 | | 200 | 200 | 200 | 200 |

Fig. 4

High Pressure Permeability Data

| High Pressure Air Permeability (5-30 sec) (5 sec Interval) | | | | | | | | | |
|---|---|---|---|---|---|---|---|---|---|
| | | | | | | | | | |
| | | | | | | | | | |
| | 1 | 2 | 3 | AVG. | | 4 | 5 | 6 | AVG. |
| | (kPa) | (kPa) | (kPa) | (kPa) | | (kPa) | (kPa) | (kPa) | (kPa) |
| 5 | 199 | 200 | 200 | 199.7 | | 200 | 200 | 200 | 200 |
| 10 | 200 | 200 | 200 | 200 | | 200 | 199 | 200 | 199.7 |
| 15 | 200 | 200 | 200 | 200 | | 200 | 200 | 200 | 200 |
| 20 | 100 | 200 | 199 | 199.3 | | 200 | 198 | 199 | 199 |
| 25 | 198 | 199 | 199 | 198.7 | | 198 | 198 | 198 | 198 |
| 30 | 197 | 198 | 198 | 197.7 | | 198 | 197 | 197 | 197.3 |

Fig. 5

FLAME RESISTANT FABRIC FOR AVIATION AIRBAGS

CLAIM OF PRIORITY

The present application is based on and a claim of priority is made under 35 U.S.C. Section 119(e) to a provisional patent application that is in the U.S. Patent and Trademark Office, namely, that having Ser. No. 61/954,847 and a filing date of Mar. 18, 2014, and which is incorporated herein by reference.

BACKGROUND OF THE INVENTION

Field of the Invention

The present invention is directed to a flame resistant fabric which may be used, among other things, in the construction of aviation airbags, and which is specifically structured to meet both the vertical flammability requirements in accordance with Federal Aviation Requirement 25.853, as well as having a high pressure permeability resistance measured as a pressure of not less than about 198 kPa after five seconds from an initial inflation and pressurization to a pressure of about 200 kPa.

Description of the Related Art

Similar to the safety regulations and requirements for most motor vehicles travelling along the highways and byways of the United States, inflatable airbag systems are required in most aircraft which traverse U.S. airways. Also, similar to the National Highway Safety Administration which issues and administers Federal Motor Vehicle Safety Standards ("FMVSS") regarding the manufacture of motor vehicles and equipment therein, the Federal Aviation Administration ("FAA") establishes standards for the regulation of aircraft and equipment utilized therein, including Federal Aviation Requirements ("FAR").

Among these common requirements, are constraints of flammability of airbag materials, regulated for automobiles via FMVSS 302, and for aircraft via FAR 25.853. More in particular FMVSS 302 establishes a horizontal burn test requirement for fabrics used in the airbags installed in automobiles for use in the United States. The FAA has established more stringent vertical burn requirement for fabrics utilized in the material of construction of inflatable airbags for use in aircraft by way of FAR 25.853. Currently, however, no fabric is known or utilized in the aircraft industry which meets the vertical burn requirement of FAR 25.853, and therefore, the FAA has been forced to provide a waiver of the vertical flammability requirement and instead only requires that manufactures meet the horizontal burn test requirements of the less stringent FMVSS 302.

In addition to the flame test requirements under FAR 25.853, materials of construction for inflatable airbags for installation in aircraft also meet a high pressure permeability resistance. More in particular, fabrics for use in aviation airbags must exhibit a high pressure permeability resistance which is measured as a pressure of not less than about 198 kilopascals ("kPa") after five seconds from an initial inflation and pressurization to 200 kPa.

In view of the foregoing, it is understood and appreciated by those of skill in the art that it will be beneficial to provide a flame resistant fabric for use in the construction of various components for aircraft, including, but not limited to, aviation airbags. A further benefit may be realized by providing a flame resistant fabric which meets the vertical flammability requirements in accordance with FAR 25.853. Yet another benefit may be realized by providing such a flame resistant fabric which also comprises high pressure permeability resistant which is in compliance with FAA requirements.

It would be further appreciated from the foregoing that considerable benefits will be realized for the safety of passengers and crew in aircraft flying throughout the world to provide a flame resistant fabric for the construction of aviation airbags which meets the stringent vertical flammability requirements of FAR 25.853 as well as meeting the FAA's high pressure permeability resistance requirements, such as the present inventive flame resistant fabric discussed in greater detail hereinafter.

SUMMARY OF THE INVENTION

It is one aspect of the present invention to provide a flame resistant fabric for use in the construction of the components for aircraft.

It is a further aspect of the present invention to provide a flame resistant fabric for use in aviation airbags installed in aircraft which is treated with a flame retardant such that the fabric is in conformance with Federal Aviation requirement FAR 25.853 for vertical flammability.

Yet another aspect of the present invention is to provide flame resistant fabric for use in aviation airbags installed in aircraft which is coated to provide high pressure permeability resistance in accordance with FAA requirements.

In yet one further aspect, the present invention provides a flame resistant fabric for use in aviation airbags which is coated to provide a high pressure permeability resistance which is measured as a pressure of not less than about 198 kilopascals ("kPa") after five seconds from an initial inflation and pressurization to 200 kPa.

One further aspect of the present invention is to provide a flame resistant fabric for use in aviation airbags installed in aircraft which is coated to provide a high pressure permeability resistance which is measured as a pressure of not less than about 198 kPa after five seconds from an initial inflation and pressurization to about 200 kPa, wherein the coating comprises a flame retardant such that the fabric is in conformance with Federal Aviation requirement FAR 25.853 for vertical flammability.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1 presents a table illustrative of the results of vertical flammability testing in accordance with FAR 25.853 for a silicone coated nylon fabric;

FIG. 2 presents a table illustrative of the results of vertical flammability testing in accordance with FAR 25.853 for an uncoated flame resistant polyester fabric;

FIG. 3 presents a table illustrative of the results of vertical flammability testing in accordance with FAR 25.853 for a flame resistant polyester fabric coated with a flame retardant polyurethane in accordance with the present invention;

FIG. 4 presents a table illustrative of the results of high pressure air permeability testing for a flame resistant polyester fabric coated with a flame resistant polyurethane in accordance with the present invention; and FIG. 5 presents a table illustrative of the results of high pressure air permeability testing for a flame resistant polyester fabric coated with a flame resistant polyurethane in accordance with the present invention.

DETAILED DESCRIPTION

As stated above the present invention is directed to a flame resistant fabric for use in constructing components of an aircraft. In at least one embodiment, the present invention is directed to a flame resistant fabric for the construction of aviation airbags.

At the present time the Federal Aviation Administration ("FAA") of the United States of America has issued a number of Federal Aviation Requirements ("FAR") directed to various aspects of aircraft construction and operation. Among these requirements is Federal Aviation Administration FAR 25.853 which includes, among other things, vertical flammability requirements for materials used in many aircraft operated in the United States. More in particular, in accordance with FAR 25.853 a material for use in aircraft in the United States must meet vertical flammability requirements which include, a flame time which is not to exceed fifteen seconds, a burn length, which is not to exceed eight inches, and a drip flame which is not to exceed five seconds.

Once again, as stated above, at the present time there are no fabrics known which meet the stringent requirements of FAR 25.853 for vertical flammability which may utilized for construction of aviation airbags in aircraft operated in the United States. As such, the FAA has indefinitely waived this requirement provided that any fabric utilized for aviation airbags is sufficiently flame resistant to pass the less stringent requirements of a horizontal flame test in accordance with the Federal Motor Vehicle Safety Standard 302.

The table presented in FIG. 1 is illustrative of the results obtained for a nylon fabric which is coated with 30 grams per square meter ("gsm") of liquid silicone rubber, as is typical for use in airbag fabrics utilized in automobiles in the United States, when the fabric is subjected to vertical flammability testing in accordance with FAR 25.853. As is readily apparent from the results presented in FIG. 1, a nylon fabric coated with liquid silicone rubber fails to meet the requirements for vertical flammability resistance under 25.853. In accordance with at least one embodiment of the present invention, a flame resistant fabric for aviation airbags comprises the uncoated polyester fiber. In at least one further embodiment, a flame resistant fabric in accordance with the present invention comprises a plurality of 500 denier-96 filament polyester fibers. In yet one further embodiment, the plurality of polyester fibers of the flame resistant fabric of the present invention are woven into a plain weave pattern at a count in a range of about 49 to 53 fibers per inch by about 49 to 53 fibers per inch.

A flame resistant fabric in accordance with one embodiment of the present invention comprises a polyester fiber which has been treated with a flame retardant. In at least one embodiment, a flame resistant fabric comprises a polyester fiber substrate that has been rendered flame retardant by treatment with a phosphate-phosphonate compound having a low volatility and a high phosphorous content. In yet one further embodiment, the polyester fibers comprise an amount of the phosphate-phosphonate compound in a range of about 0.1%-0.3% by weight with respect to the weight of the polyester fiber.

In yet one further embodiment of a flame resistant fabric for aviation airbags in accordance with the present invention, a polyester fiber that has been treated with a phosphate-phosphonate compound and woven into a plain weave pattern, such as, but not limited to a count of 49-53 per inch by 49-53 per inch, is subsequently heat set to impart dimensional stability, as well as to control air permeability. In at least one embodiment, heat setting the polyester fiber comprises exposing the woven polyester fiber to temperatures in a range of about 340 degrees Fahrenheit to 420 degrees Fahrenheit for a period of time of about 30 to 60 seconds.

A flame resistant fabric for aviation airbags in accordance with at least one further embodiment of the present invention comprises a polyester fiber which has been treated with a phosphate-phosphonate compound, such as disclosed above, which is then further coated with polyurethane. In at least one further embodiment, a polyester fiber is coated with a polyurethane that includes a 1:3 flame retardant mixture of antimony trioxide:1,1'-(ethane-1,3-diyl)bis [pentabromobenzene]. In particular, the flame retardant polyurethane coating acts as an effective char former to inhibit flame spread during the course of a vertical flammability test, for example, a vertical flammability test in accordance with FAR 25.853.

Turn next to FIG. 2, the table therein illustrates that a flame retardant polyester fabric prepared in accordance with the present invention as disclosed herein comprises sufficient flame retardant properties which allow it to pass the stringent vertical flammability requirements under FAR 25.853.

Furthermore, and with reference to FIG. 3, a flame retardant polyester fabric prepared in accordance with the present invention as disclosed herein and further coated with a flame resistant polyurethane also exhibits flame resistant properties sufficient for the material to pass the vertical flammability requirements of FAR 25.853.

The application of a polyurethane coating as disclosed above assures a high pressure permeability resistance of the coated flame retardant polyester fibers. However, as is known, a polyurethane coating in and of itself increases the flammability of the material which is coated. As such, in accordance with one embodiment of the present invention, a polyurethane coating comprises a flame retardant. In at least one embodiment, a polyurethane coating in accordance with the present invention comprises a flame retardant mixture of antimony trioxide and 1,1'-(ethane-1,3-diyl)bis [pentabromobenzene], and in at least one further embodiment, a polyurethane coating comprises a mixture of about one part of antimony trioxide to about three parts of 1,1'-(ethane-1,3-diyl)bis[pentabromobenzene].

In yet another embodiment, a flame resistant fabric in accordance with the present invention having a polyester fiber which is treated with a phosphate-phosphonate compound and subsequently heat set and is then coated with a flame retardant polyurethane exhibits a high pressure permeability resistance which is measured as a pressure of not less than about 198 kPa after five seconds from an initial inflation and pressurization to about 200 kPa, such as may be encountered in and during an inflation of aviation airbag assemblies.

The tables presented in FIGS. 4 and 5 demonstrate that a flame retardant polyurethane coating further assures high pressure permeability resistance to the flame retardant polyester fibers prepared in accordance with the present invention as disclosed herein.

Since many modifications, variations and changes in detail can be made to the described embodiment of the invention, it is intended that all matters in the foregoing description and shown in the accompanying figures be interpreted as illustrative and not in a limiting sense. Thus, the scope of the invention should be determined by the appended claims and their legal equivalents.

Now that the invention has been described,

What is claimed is:

1. A fabric for the construction of an airbag for installation in an aircraft, said fabric comprising:

a high tenacity continuous polyester filament yarn, said high tenacity continuous polyester filament yarn comprising:

a 500 denier-96 filament polyester fiber substrate; and an amount of phosphate-phosphonate compound in a range of about 0.1%-0.3% by weight;

a plain weave utilizing said high tenacity continuous polyester filament yarn, characterized by a count of 49-53 per inch by 49-53 per inch, said plain weave having a first fabric side and a second fabric side, where said plain weave has been heat set to between 340 degrees Fahrenheit to 420 degrees Fahrenheit for a period of time of about 30 to 60 seconds; and a composition comprising polyurethane with flame retardant additives, said composition applied as a coating to the first fabric side and the second fabric side at a coating weight of between 25-50 grams per square meter;

wherein said fabric, when subjected to aviation vertical flammability requirements, is characterized as: being self-extinguishing; having an average burn length not exceeding 8 inches; having an average flame time after removal of the flame source not exceeding 15 seconds; and having drippings that do not continue to flame for more than 5 seconds after falling; and is further characterized as exhibiting a high pressure permeability resistance characterized as a pressure of not less than 198 kPa after five seconds from an initial inflation and pressurization to 200 kPa.

* * * * *